United States Patent [19]

Giannini

[11] Patent Number: 4,635,516

[45] Date of Patent: Jan. 13, 1987

[54] TONE GENERATING GLOVE AND ASSOCIATED SWITCHES

[76] Inventor: Giancarlo Giannini, Via Giuseppe Mercalli 46, Rome, Italy

[21] Appl. No.: 651,866

[22] Filed: Sep. 17, 1984

[51] Int. Cl.[4] ..... G10H 1/00; G10H 5/00

[52] U.S. Cl. ..... 84/1.01; 446/26; 84/DIG. 7; 84/DIG. 8; 2/160

[58] Field of Search ..... 84/1.01; D2/360; 223/78; 446/26, 408, 446; 2/159, 160; 84/DIG. 7, DIG. 8

[56] References Cited

U.S. PATENT DOCUMENTS

| | | | |
|---|---|---|---|
| 1,165,970 | 12/1915 | Harris . | |
| 2,780,954 | 2/1957 | Bryce | 446/26 |
| 3,027,794 | 4/1962 | Chute | 2/160 |
| 3,704,339 | 11/1972 | Niinomi . | |

*Primary Examiner*—Stanley J. Witkowski
*Assistant Examiner*—David Warren
*Attorney, Agent, or Firm*—Curtis, Morris & Safford

[57] ABSTRACT

A tone generating glove includes switches and a tone generating circuit. The switches are connected to the tone generating circuit, and both the switches and the tone generating circuit are mounted in the glove. The tone generating circuit produces a tone or tones in response to the actuation of one or more of the switches. Preferably, a switch is positioned at each finger joint of the glove. The tone generating glove may also include a transmitter for transmitting the tone or tones that are produced to an AM or FM receiver. Each switch may include a flexible insulating sheet having upper and lower surfaces and an opening formed through its thickness. Flexible and electrically conductive first and second outer laminas are respectively attached to the upper and lower surfaces of the insulating sheet. They are positioned on the surfaces of the insulating sheet so as to bridge the opening in it. The first and second outer laminas are dimensioned to be at least partially received by the opening when the switch is flexed. Each switch may also include a bulbous insulating pad disposed on the underside of the second outer lamina and aligned with the opening in the insulating sheet.

6 Claims, 6 Drawing Figures

FIG. 1
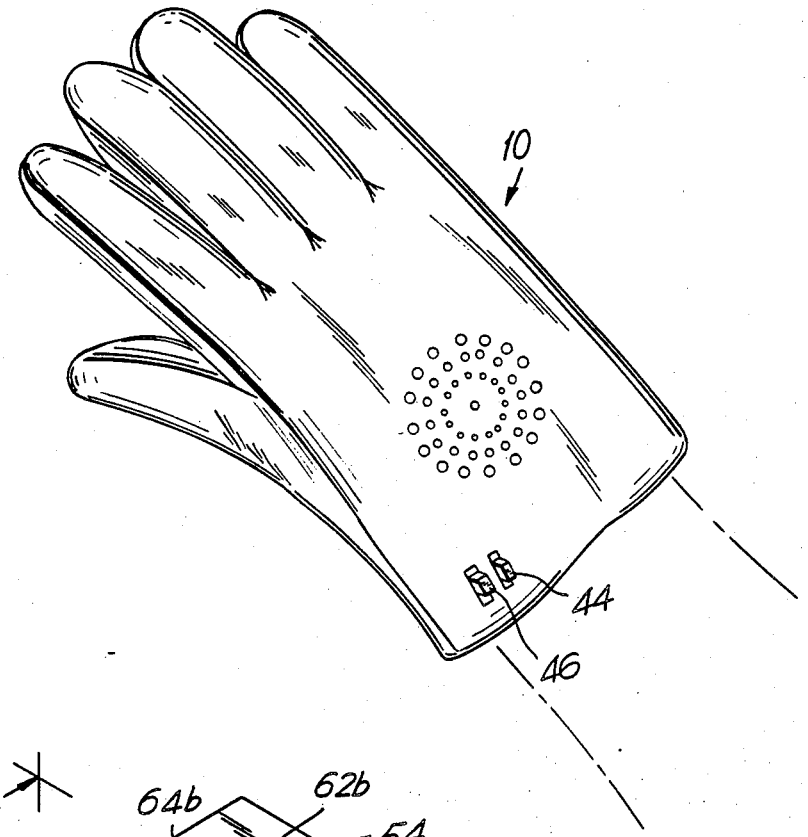
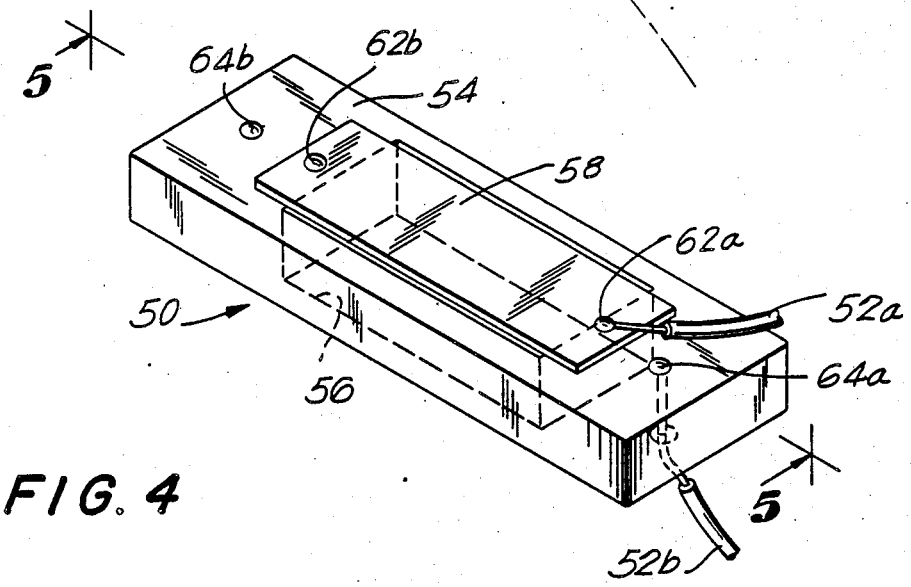
FIG. 4

TONE GENERATING GLOVE AND ASSOCIATED SWITCHES

BACKGROUND OF THE INVENTION

1. Field of the Invention

This invention relates to clothing which is adapted to produce a musical tone. More particularly, it pertains to a tone generating glove that includes switches, which, when selectively actuated by the wearer, cause an audible tone to be produced.

2. Description of the Prior Art

It is well known in the art to provide gloves with a switch or contacts that, when closed, actuate an electronic circuit. For example, U.S. Pat. No. 1,165,970, which issued to Edward Harris, discloses a glove adapted to be used by trainmen, policemen, conductors, etc., for signaling purposes. The signaling glove includes exposed contacts on the thumb and index finger. By pressing the thumb against the index finger, an electrical connection is made through the contacts and a light is lit or an alarm is energized.

It is also well known in the art to provide various articles of clothing, such as a glove, with movement sensing devices such that bodily movements actuate an electronic circuit. For example, U.S. Pat. No. 3,704,339, which issued to Naoyuki Niinomi, illustrates in FIGS. 11A through 11D gloves having electrodes 96A and 96B. The electrodes pick up variations in bodily voltages caused by muscular contractions of the wearer of the gloves. The signals detected by the electrodes are sent to a muscular voltage processing circuit. The output of the muscular voltage processing circuit is supplied as a control signal to a tone modifying circuit.

There are many inherent drawbacks with the device disclosed in the Niinomi patent. One particular disadvantage of the device is that it relies on electrodes to detect bodily movements. The electrodes are placed against the skin of the wearer at selected muscular areas. As mentioned previously, the electrodes detect minute voltages produced by muscular contractions. Because of the low amplitudes of the voltages that are detected, the electronic circuit of the Niinomi device is highly sensitive to the location of the electrodes. Moreover, the circuit may be desensitized when the electrodes are mounted in an article of clothing, such as a glove, especially if the article is loose fitting. Optimally, the electrodes should be placed against the skin with the aid of an electrically conductive paste or bonding tape, as disclosed at column 2, lines 54 through 59, of the Niinomi patent. However, the person's mobility may be decreased if the electrodes are positioned in this fashion.

A second disadvantage of the musical device disclosed in the Niinomi patent is the complexity of the circuit. Inasmuch as the device relies on the detection of voltage variations produced by muscular contractions, a complicated signal processing circuit is necessary. The complex circuit required to detect voltages due to muscular contractions may increase the manufacturer's cost of producing the device and may significantly add to the weight and size of the device. The voltage detection and manufacturing problems may be compounded if the Niinomi circuit is mounted in a glove, such as the gloves **97*a* and 97*b*** shown in FIGS. 11A through 11D, that is worn by the player, rather than mounted in a separate housing, such as the organ illustrated in FIG. 7A.

SUMMARY OF THE INVENTION

An object of the present invention is to provide a musical or tone generating glove that reliably produces particular musical tones in response to the movements of the fingers or the hand of the wearer.

Another object of the present invention is to provide a tone generating glove in which the circuitry for detecting finger movements and the circuitry for producing musical tones are mounted entirely within the glove.

Yet another object of the present invention is to provide a switch adapted for use in a tone generating glove that can be easily controlled and actuated by the wearer of the glove.

The present invention overcomes the problems with and the disadvantages of the prior art. More specifically, it satisfies the need for a simple, uncomplicated, inexpensive, and reliable novelty that produces musical tones in response to movements of the fingers or the hand. Moreover, a device according to the present invention is lightweight and readily portable.

A musical or tone generating glove according to the present invention includes a plurality of switches that are mounted in the glove and a tone generating circuit that is also mounted in the glove. Each of the switches is connected to the tone generating circuit, and it generates a tone or tones in response to the actuation of one of the switches. The switches may be positioned at each finger joint of the glove so that they are easily actuated by movements of the fingers or the hand. Preferably, the tone generating circuit generates a plurality of tones, and each one of the switches uniquely corresponds to each one of the tones.

A musical or tone generating glove according to the present invention advantageously includes a transmitter, which is mounted in the glove and connected to the tone generating circuit. The transmitter sends to a receiver signals corresponding to each of the tones produced by the tone generating circuit.

A switch according to the present invention is particularly adapted for use in a tone generating glove. Such a switch includes a flexible insulating sheet having upper and lower surfaces. The insulating sheet has an opening formed through its thickness. First and second outer laminas are mounted respectively on the upper and lower surface of the insulating sheet. Each outer lamina is flexible and electrically conductive, and they are positioned on the surfaces of the insulating sheet to bridge the opening. Each outer lamina is dimensioned to be at least partially received by the opening when the switch is flexed. Thus, when the wearer of the glove bends his finger, which flexes the switch, the first and second outer laminas move towards one another and come into contact, thereby completing a circuit through the switch.

The above and other objects, features, and advantages of the present invention will be apparent from the following detailed description of an illustrative embodiment thereof, which is to be read in connection with the accompanying drawings.

BRIEF DESCRIPTION OF THE DRAWINGS

FIG. 1 is a perspective view of a tone generating glove according to the present invention.

FIG. 4 is a perspective view of a switch for a tone generating glove according to the present invention.

DETAILED DESCRIPTION OF THE PREFERRED EMBODIMENT

Figure 2:
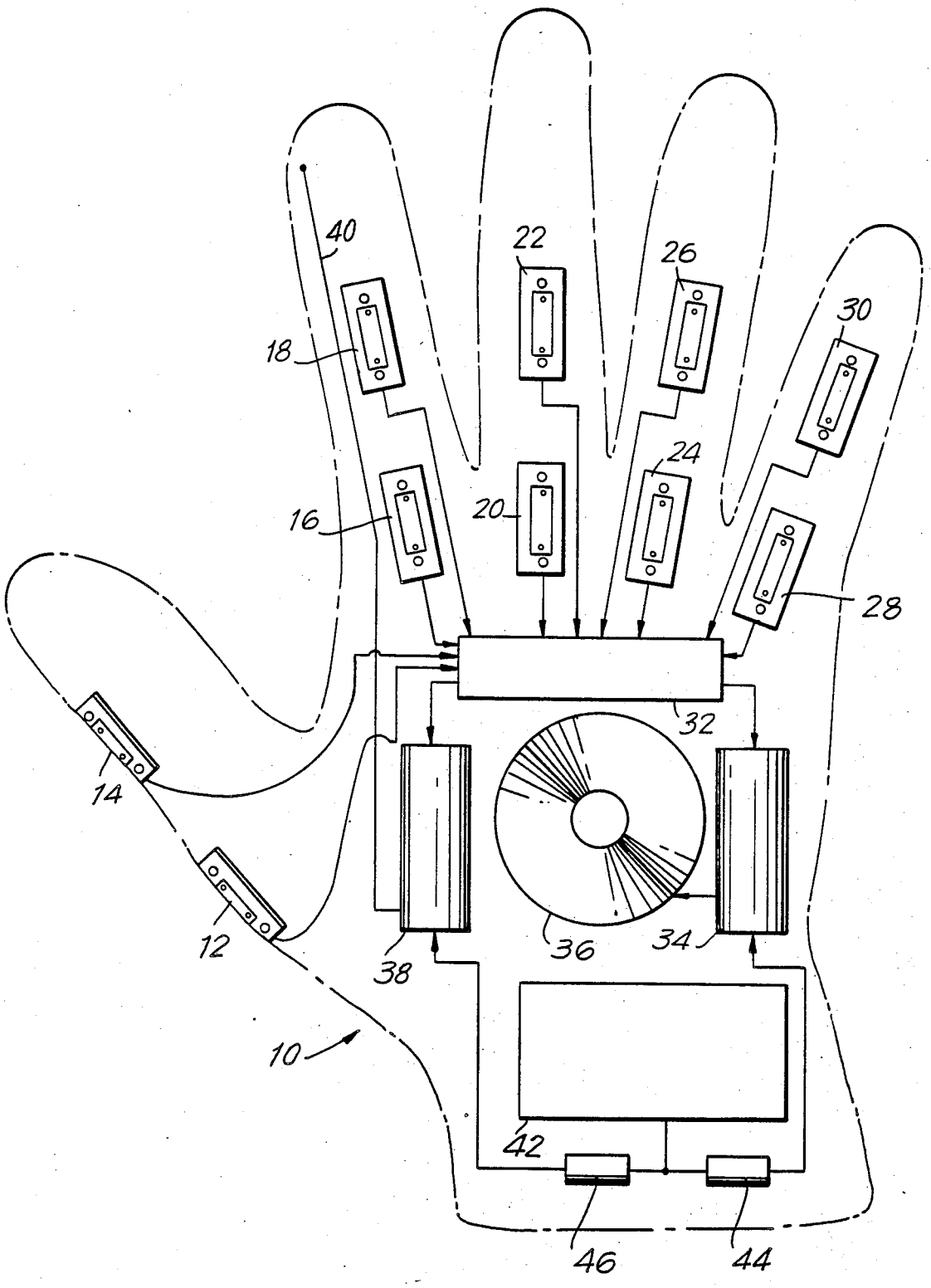
FIG. 2 is a diagrammatic illustration of a tone generating glove according to the present invention and shows the positions of the switches and other components in the glove.

Referring now to the drawings, and more particularly to FIGS. 1 and 2, a tone generating glove according to the present invention is generally designated by the reference numeral 10. The glove 10 includes switches 12 through 30. Preferably, a switch is positioned at each finger joint of the glove, i.e., over each knuckle of the hand. The switches 12 through 30 are connected by leads to a tone generating circuit 32. The switches 12 through 30 will be described in greater detail during the description of FIGS. 4 through 6, below. Although the glove 10 is shown and described as having the switches illustrated in FIGS. 4 through 6, other switch types may be utilized. For example, a switch with an insulating bottom layer having two conductive strips thereon and a conductive top layer is also suitable.

The tone generating circuit 32 is connected to an amplifier 34, which drives a speaker 36. The amplifier 34 may also drive a headphone (not shown), which would be connected to the amplifier 34 through a detachable plug (not shown). The tone generating circuit 32 is also connected to a transmitter 38, which transmits through an antenna 40.

The wearer of the glove moves a finger in order to close one of the switches 12 through 30. A switch closure is detected by the tone generating circuit 32, and it produces a tone in response. Each tone produced by the tone generating circuit 32 is amplified by the amplifier 34 and supplied to the speaker 36. Additionally, each tone produced by the tone generating circuit 32 is sent to the transmitter 38, which then transmits it through the antenna 40 to an AM or FM receiver, where it is amplified and provided to an external speaker.

A battery 42 supplies power to the tone generating circuit 32, the amplifier 34, and the transmitter 38, through the control switches 44 and 46. Accordingly, the transmitter may be energized while the amplifier is deenergized or the amplifier may be energized while the transmitter is deenergized or both may be energized simultaneously. All of the components illustrated in FIGS. 1 and 2 are mounted entirely within the glove 10. Preferably, the components are mounted on several elongated, insulating strips that are mounted in the glove 10.

Figure 3:
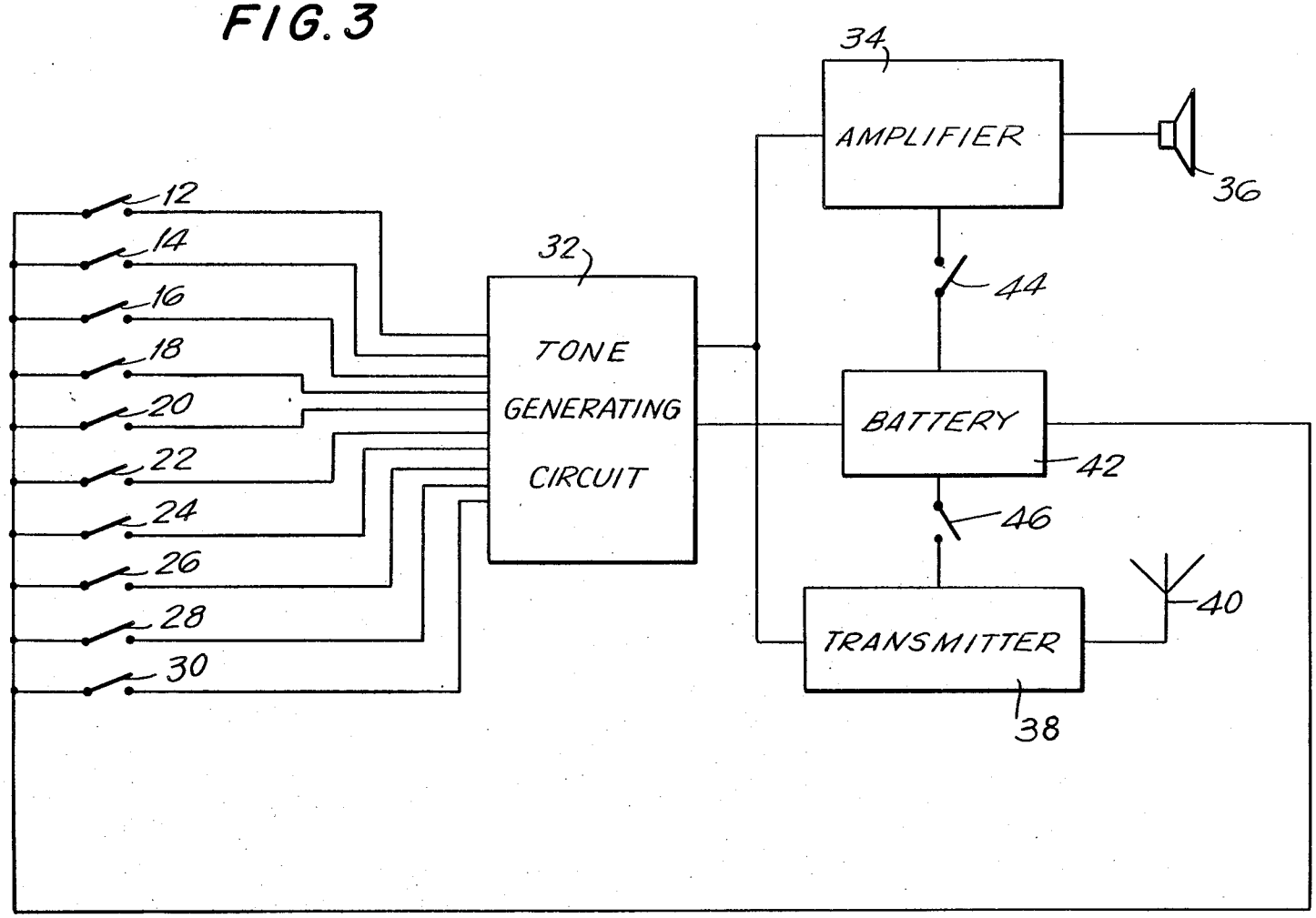
FIG. 3 is a block diagram of a circuit for a tone generating glove according to the present invention.

FIG. 3 is a block diagram of a circuit for a tone generating glove according to the present invention. As set forth above, the switches 12 through 30 provide input signals to the tone generating circuit 32, and it provides an output signal to the amplifier 34 and the transmitter 38. Preferably, the tone generating circuit 32 produces a different tone in response to the actuation of each different switch. In other words, each of the switches uniquely corresponds to each of the tones. For instance, the tone generating circuit 32 may produce ten different notes. Electronic circuits that produce different tones or notes in response to the actuation of different switches are known. Conventional electronic organs include such circuits. Another example of such a circuit is an R-C oscillator circuit in which a string of resistors is connected in the base circuit of a transistor; each switch shorts out a different number of resistors in the string and, therefore, changes the output frequency of the oscillator.

Figure 5:
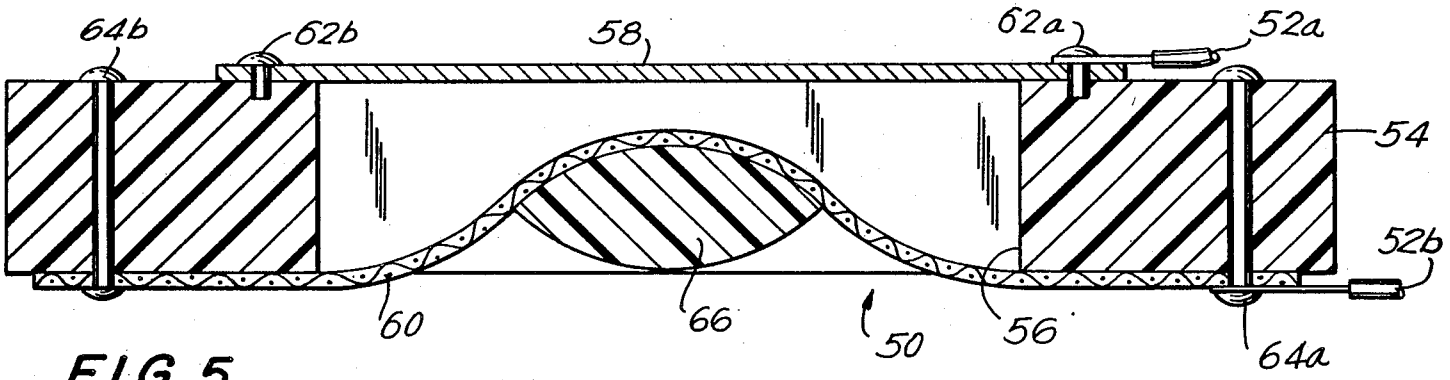
FIG. 5 is a cross-sectional view of the switch shown in FIG. 4 that is taken along lines 5—5 and illustrates the switch in its open or unactuated position.
Figure 6:
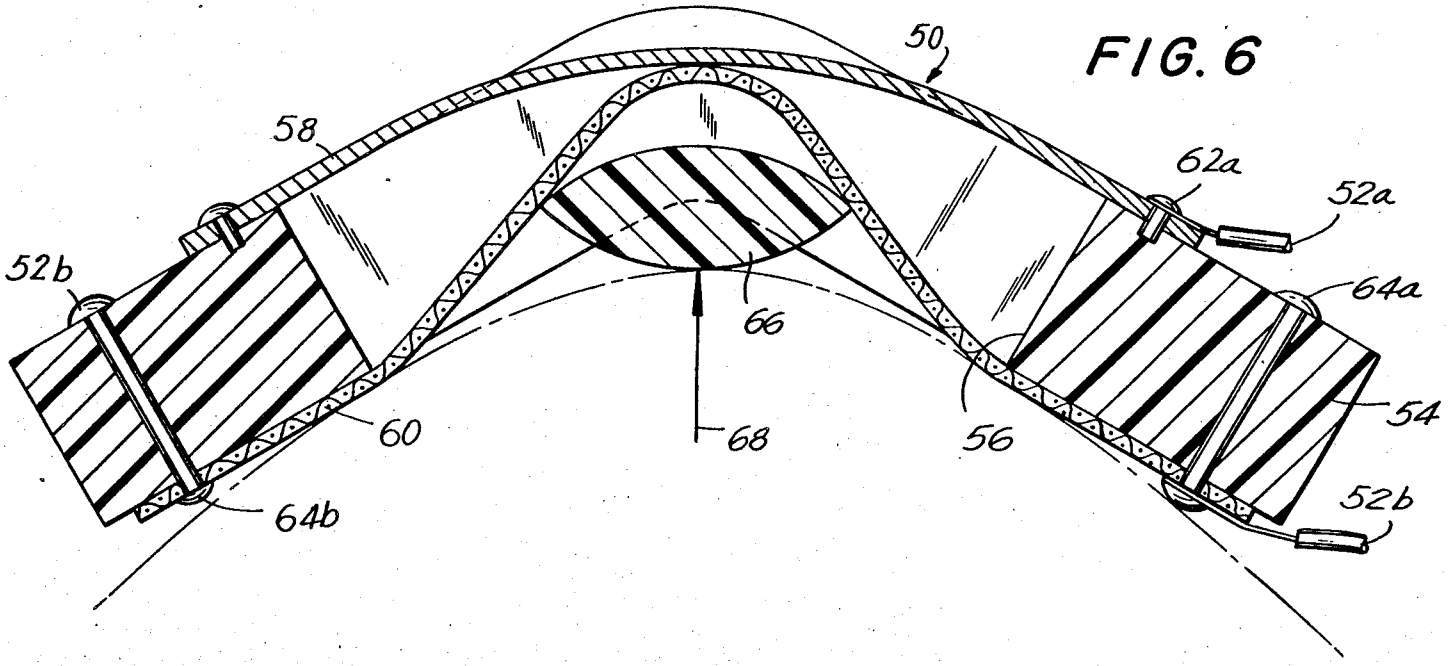
FIG. 6 is a cross-sectional view of the switch shown in FIG. 4 that is taken along lines 5—5 and illustrates the switch in its closed or actuated position.

As specified previously, FIGS. 4 through 6 illustrate a switch, which is generally designated by the reference numeral 50, that is adapted for use in a tone generating glove according to the present invention. The switch 50 includes leads 52*a* and 52*b*. The switch 50 also includes a flexible insulating sheet 54 that has an opening 56 formed therein. A flexible and electrically conductive top lamina or layer 58 is attached to the upper surface of the insulating sheet 54. The top layer 58 is positioned so as to bridge the opening 56. A flexible and electrically conductive bottom lamina or layer 60 is attached to the lower surface of the insulating sheet 54. The bottom layer 60 is also positioned so as to bridge the opening 56. The two opposite ends of the top layer 58 are attached to the insulating sheet 54 by fasteners 62*a* and 62*b*, while the two opposite ends of the bottom layer 60 are attached to the insulating sheet 54 by fasteners 64*a* and 64*b*. The fasteners 62*a* and 64*a* also function as terminals for the leads 52*a* and 52*b*, respectively. Preferably, the switch 50 includes a bulbous insulating pad 66 that is located on the underside of the bottom layer 60 and aligned with the opening 56 in the insulating sheet 54.

FIG. 5 depicts the switch 50 in its open or unactuated position. In this position, the top layer 58 does not contact the bottom layer 60. In contrast, FIG. 6 depicts the switch 50 in its closed or actuated position. In this position, the top layer 58 is received by the opening 54 and contacts the bottom layer 60, thereby closing the switch. The switch 50 is actuated by a force denoted by the arrow 68. Such a force may be applied when a finger is bent.

The insulating pad 66 is positioned to enhance the force on the switch 50 and make the switch easier to close. Moreover, the bottom layer 60 may be more flexible than the top layer 58 in order to reduce the switch closing force. For instance, the bottom layer 60 may be made from a wire mesh (as shown), while the top layer 58 is made from a copper sheet.

Although a particular illustrative embodiment of the present invention has been described herein with reference to the accompanying drawings, the present invention is not limited to that particular embodiment. Various changes and modifications may be made thereto by those skilled in the art without departing from the spirit or scope of the invention, which is defined by the appended claims.

I claim:

1. A tone generating glove, comprising:

a glove;

a plurality of switches mounted in said glove; and tone generating means for generating a tone, said tone generating means being mounted in said glove, each of said switches being connected to said tone generating means, said tone generating means generating a tone in response to actuation of one of said switches.

2. A tone generating glove as recited in claim 1, wherein said tone generating means generates a plurality of tones.

3. A tone generating glove as recited in claim 2, wherein each one of said switches uniquely corresponds to each one of said tones.

4. A tone generating glove as recited in claim 1, wherein said tone generating means is mounted on a plurality of elongated, insulating strips, said strips being mounted in said glove.

5. A tone generating glove as recited in claim 1, further comprising transmitter means for transmitting to a receiver a signal representative of a tone generated by said tone generating means, said transmitter means being mounted in said glove and being connected to said tone generating means.

6. A tone generating glove as recited in claim 1, wherein a switch is positioned at each finger joint of said glove.

* * * * *